United States Patent [19]

St. Clair

[11] Patent Number: 4,915,376

[45] Date of Patent: Apr. 10, 1990

[54] ANIMATED EXERCISER APPARATUS

[76] Inventor: Bill D. St. Clair, Rte. 1, Box 158-D, Ingleside, Tex. 78362

[21] Appl. No.: 187,279

[22] Filed: Apr. 28, 1988

[51] Int. Cl.[4] ..... A63G 17/00; A63B 21/00

[52] U.S. Cl. ..... 272/73; 272/53.2; 280/1.204

[58] Field of Search ..... 272/73, 53.2, 53.1, 272/114; 280/1.81, 1.188, 1.203, 1.204, 1.206, 1.208, 1.192

[56] References Cited

U.S. PATENT DOCUMENTS

| | | | |
|---|---|---|---|
| 491,927 | 2/1893 | Rygg . | |
| 503,991 | 8/1893 | Snyder | 280/1.204 |
| 710,218 | 9/1902 | Seng . | |
| 967,641 | 8/1910 | Joseph . | |
| 2,473,649 | 6/1949 | Jensen . | |
| 2,627,419 | 2/1953 | Lindenbein . | |
| 2,680,020 | 1/1954 | Dwyer . | |
| 3,037,769 | 6/1962 | Deady | 272/53.2 |
| 3,068,000 | 12/1962 | Hanson . | |

FOREIGN PATENT DOCUMENTS

| | | | |
|---|---|---|---|
| 0222222 | 9/1924 | United Kingdom | 280/1.204 |

*Primary Examiner*—Stephen R. Crow

*Attorney, Agent, or Firm*—Pravel, Gambrell, Hewitt, Kimball & Krieger

[57] ABSTRACT

An apparatus which provides both amusement and exercise takes the form of a simulated animal or other body with pedals attached. A rider sitting on the body drives the pedals. As the pedals are driven, gearing within the body imparts a reciprocating upward and forward movement of the body, as if the body, particularly when that of an animal, were running or walking. The gearing arrangement also reduces the amount of effort a rider must expend to move the simulated animal body weight to overcome the effect of the rider's own weight. With the gearing within the body, little chance of injury to others exists. The gearing also imparts a more realistic simulation of running movement of an animal.

18 Claims, 3 Drawing Sheets

ANIMATED EXERCISER APPARATUS

BACKGROUND OF INVENTION

1. FIELD OF INVENTION

The present invention relates to an amusement/exercise apparatus which simulates running movement of an animal or other amusing or fanciful shape or figure.

2. DESCRIPTION OF PRIOR ART

Hobby horses or rocking horses of the conventional type are well known. Those on merry-go-rounds and the machine driven, coin operated type often found at or near retail stores have attempted to provide some measure of sensation that the horse, or other animal being simulated, is running or moving.

Attempts have been made in the prior art to include a pedal drive mechanism so as to include a capability for exercise by the rider. For example, U.S. Pat. Nos. 710,218; 2,473,649 and 3,068,000 all were attempts to permit a rider to use foot pedals to cause movement of the simulated animal body. Several problems, however, existed. First, the rider driving the pedals to cause the animal body to move had to exert enough force to move both the animal body and the rider's own weight. For the typical child rider, this was often a quite difficult task. Further, the gearing and drive mechanisms driven by the pedals were exposed between the support frame and the animal body. With children typically being intended to be the principal users of these apparatus, the possibility of another child's fingers or limbs being caught in the gearing and drive mechanisms was always present. Another factor was that in the devices disclosed in these prior patents, motion of the simulated animal bodies was at best only an attempt to simulate the actual physical movement of the actual animal's body in motion.

Other patents of which applicant is aware which are related to the general nature of the present invention are U.S. Pat. Nos. 491,927; 967,641; 2,627,419; and 2,680,020.

SUMMARY OF INVENTION

Briefly, the present invention provides a new and improved animated exerciser which includes a simulated movable body, which can be a simulation of an actual or imaginary animal, motor vehicle, or other fanciful shape or figure. The simulated body is mounted on a support for movement above a floor or surface. The body has a seat on which a rider may sit and engage pedals which extend outwardly from the body. As the pedals are driven, gearing mounted inside the body is driven, causing the body to move relative to the support, simulating movement of the body. With the gearing within the body, the risk of injury to others while the exerciser is being ridden is greatly reduced. The gearing in the exerciser is of a nature to impart a forward and upward motion, with return, as the pedals are driven, giving the rider a sensation that the body is moving, when an animal is simulated, much in the manner of a running animal. The simulated body is mounted on the support by a resilient mechanism, such as a spring, so that at least a portion, and if desired all, of the weight of the rider is borne. In this manner the rider need not work against this amount of weight, reducing the amount of weight to be overcome while pedalling.

DESCRIPTION OF PREFERRED EMBODIMENT

Figure 1:
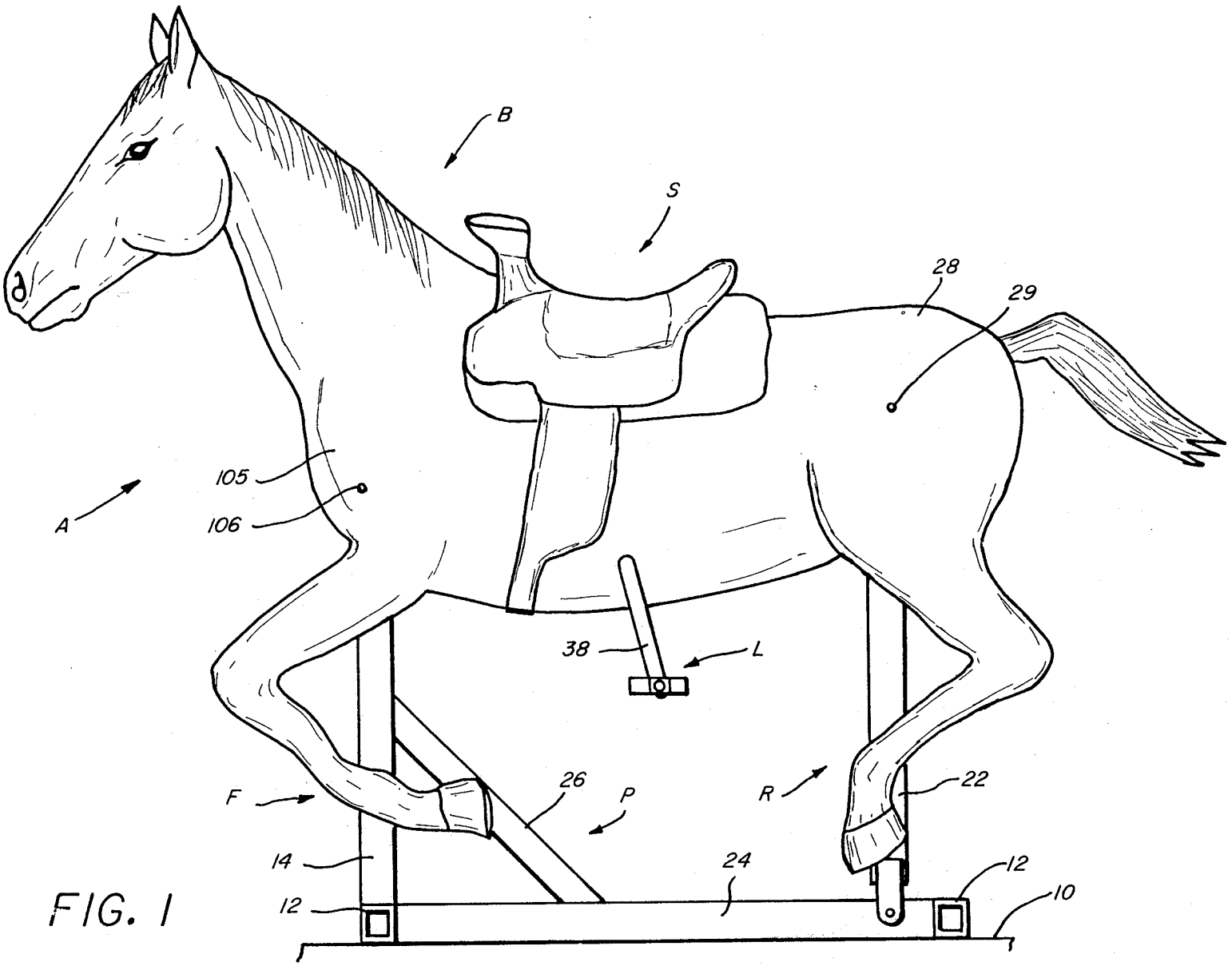
FIG. 1 is an elevation view of an animated exerciser apparatus according to present invention.

In the drawings, the letter A designates generally an animated exerciser apparatus according to the present invention. The apparatus A includes a simulated movable body B, in the preferred embodiment that of a horse. It should be understood, however, that the movable body B may be a simulation of an actual or imaginary animal, a motor vehicle, or any other amusing or fanciful shape or figure. The simulated body B is preferably molded from fiberglass or other suitable synthetic resin and is dyed or otherwise colored into suitable attractive colors, depending upon the type of body being simulated. The body B includes a surface or seat S formed thereon where a rider of the apparatus A may sit. The body B is preferably formed to enclose a substantial portion of the apparatus A internally therein (FIG. 1). A substantial portion of the body B has been removed from FIG. 2, so that internal components of the apparatus A may be clearly seen.

The apparatus A further includes a support system P which supports the body B for movement above a floor or surface 10. A pair of pedals L are formed extending outwardly of the body B (FIG. 4) below the seat S for engagement by a rider's feet and being driven by the rider's feet. The pedals L are connected to a gear system G (FIGS. 2 and 4) mounted within the body B. The gear system G responds to the pedals L being driven by the rider and moves the body B relative to the support P.

Figure 3:
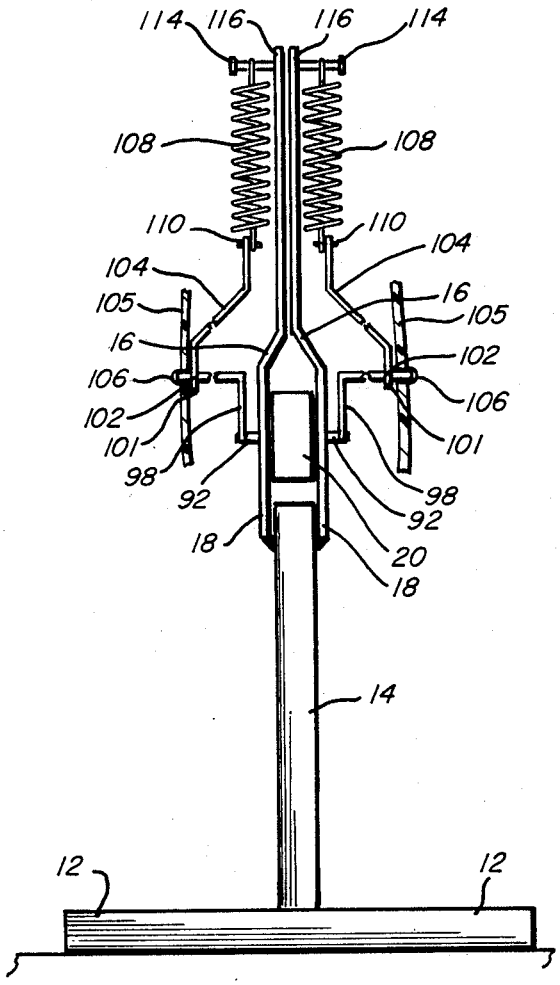
FIG. 3 is a cross-sectional view, taken along the lines 3—3 of FIG. 1.

Turning to the support P, a front support mechanism F includes a pair of transversely extending support arms or bars 12 extending laterally outwardly from a front support post 14. The front support post 14 extends upwardly through an opening of suitable size formed in a lower front portion of the body B. A pair of yoke arms 16 are mounted at their lower ends 18 (FIG. 3) on opposite sides of the front support post 14 to form a yoke within which a front gear box 20 of the gear mechanism G is received.

A rear support R of the support mechanism P includes a pair of transversely outwardly extending support arms or bars of like structure to those of the front support F. They accordingly bear the like reference number 12. Above the outwardly extending rear support arms 12 is mounted an upwardly extending rear support post 22. The rear support post 22 extends upwardly through an opening of suitable size formed in a lower rear portion of the body B.

The front and rear transversely extending support arms 12 are interconnected by a longitudinally extending support bar or arm 24 mounted on the floor or surface 10. For additional strength, a support strut 26 is mounted between the longitudinal support arm 24 and the front support post 14. The rear support post 22 is pivotally connected to a rear portion 28 of the body B by means of a pivot pin 30 extending transversely from an outer head or stud 29 on each side through and between inner side walls of the rear portion 28 of the body B and passing through an opening 22a formed in the rear support post 22. If desired, bearings of suitable size may be included to insure freedom of pivoting movement of the rear portion 28 of the body B with respect to the rear support R.

Figure 4:
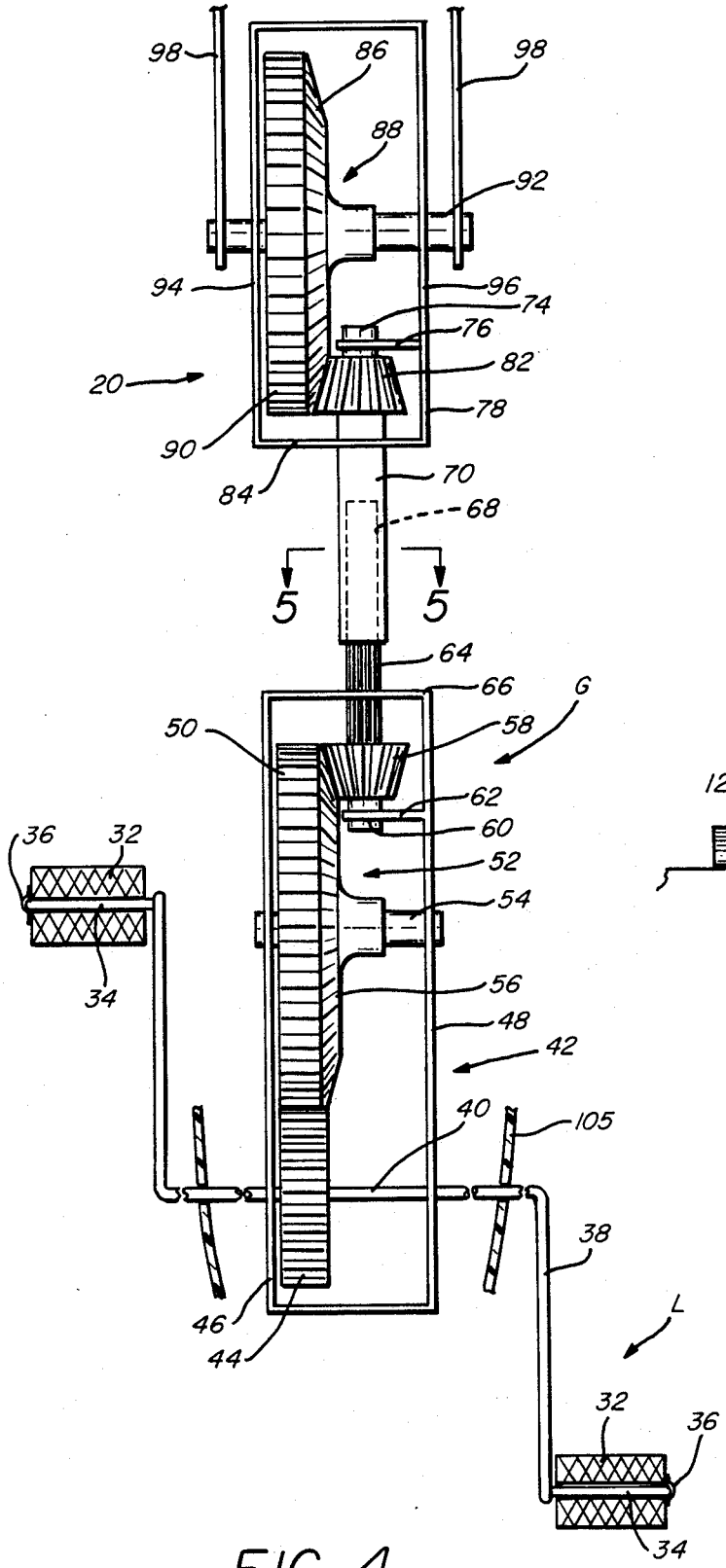
FIG. 4 is an elevation view of the gearing mechanism of the animated exerciser apparatus of FIGS. 1 and 2.

Each of the pedals L has conventional foot pads 32 of rubber or other suitable material rotatably mounted on a pedal shaft 34 and held in place thereon by an end cap 36 (FIG. 4). FIG. 4 is somewhat larger in scale from the other figures so that components illustrated may be more clearly seen. The pedal shaft 34 of each of the pedals L is connected at a lower end of a pedal crank arm 38. The pedal crank arms 38 extend outwardly at each end of a pedal shaft 40 which is mounted for rotational movement) within a rear gear box 42. The length of the pedal shaft 40 is such that it extends outwardly from the gear box 42 through a suitable opening in the body B. In this manner, the gear mechanism G is mounted entirely within the body B, with only the pedal shaft 40 and the pedal crank arms 38 of pedals L extending outwardly from the body B.

A pedal driven gear 44 is mounted within the rear gear box 42 between side walls 46 and 48. As the pedals L are driven by the rider, the pedal driven gear 46 is also driven and engages radial teeth 50 of a transfer gear 52. The transfer gear 52, which is preferably a reduction gear, is mounted on a gear shaft 54 for relative rotational movement when driven by the pedal driven gear 44. The transfer gear 52 further has beveled gear teeth on a surface 56 thereof which engage with and drive a rear bevel transfer gear 58 mounted on a rear gear shaft 60.

The rear gear shaft 60 is rotatably mounted within a support arm 62 extending inwardly from side wall 48 of the gear box 42. The rear gear shaft 60 has a number of longitudinally splined gear teeth 64 formed on an outer surface thereof. Adequate clearance is provided in an upper or front wall 66 of the gear box 42 for free rotational movement of the gear teeth 64 when the rear bevel transfer gear 58 is driven by the transfer gear 52. The splined gear teeth 64 extend longitudinally along the length of the rear gear shaft 60 along the full extent thereof to an uppermost end 68 which is housed within a gear sleeve 70 of the front gear box 20.

Figure 5:
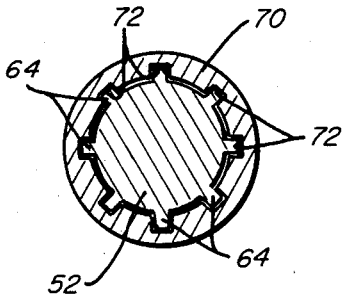
FIG. 5 is a cross-sectional view taken along the lines 5—5 of FIG. 4.

The gear sleeve 70 has corresponding longitudinal grooves 72 into which the splined gear teeth 64 of the rear gear shaft 62 fit (FIG. 5), so that the gear sleeve 70 and splined gear teeth 64 form a drive shaft. The gear sleeve 70 is mounted on a front gear shaft 74 for rotational movement with respect to a support arm 76 mounted on a side wall 78 of the front gear box 20. Adequate clearance or bearings are provided so that the gear sleeve 70 may freely rotatably move with respect to the gear box 20 when driven by the splined gear teeth 64 of rear gear shaft 60.

It is to be noted that the splined gear teeth 64 are not fixedly connected with the gear sleeve 70. Accordingly, for reasons to be set forth below, the rear gear shaft 60 and the front gear shaft 74 may move rotationally with each other, due to the engagement between gear teeth 64 and grooves 72, and longitudinally with respect to each other when the pedals L are being driven. Again, provision is made, either through adequate clearance or bearings, for relative rotational movement of the gear sleeve 70 with respect to a lower or rear wall 84 of the front gear box 20. The teeth of the front bevel transfer gear 82 engage and mesh with bevel teeth 86 of an upper driven gear 88. The upper driven gear 88, which is preferably a reduction gear, causes movement of the body B with respect to the front support F, as will be set forth. The upper driven gear 88 is shown in the drawings as having teeth 90 which are actually not necessary for the operation of the present invention. However, since the upper gear 88 and the lower gear 52 are preferably of like size and can thus be interchangeable, for ease and economy of manufacturing, they are identically formed.

The transfer gear 88 is mounted on a drive shaft 92 which is rotatably mounted with and passes through side walls 94 and 96 of the front gear box 20. A lower arm 98 of a rotary drive linkage 100 is mounted at each end of the drive shaft 92. Each of the lower drive arms 98 is pivotally connected at an upper end 101 by a pivot pin 102 to an upper arm 104 of the rotary drive linkage 100. The pivot pin 102 extends outwardly from the connection between arms 98 and 104 through a front portion 105 of the body B to an outer head or stud 106. At an upper end 107 of the upper arms 104, a resilient member, for example a coil spring 108, is connected at its lower end by a connector pin 110 to the upper arm 104 of the rotary drive linkage 100. It should be understood, however, that other resilient mechanisms than coil springs 108 may be used.

The coil springs 108 are pivotally mounted at upper ends 112 to connector arms 114 which extend outwardly from upper ends 116 of yoke arms 16 of the front support F. The coil springs 108 serve to bear at least a portion, if not all, of the body weight of the rider.

In the operation of the present invention, a rider sits on the seat S above the body B and drives the pedals L. Because of the spring 108, a substantial portion, if not all, of the weight of the body B and the rider is absorbed. Accordingly, the rider need not expend energy overcoming the combination of the weight of the body B and the rider's body, making use of the apparatus A particularly easy for younger children as riders. Further, it is to be noted that the seat S is approximately centrally located between front support F and rear support R for load distribution purposes.

Figure 2:
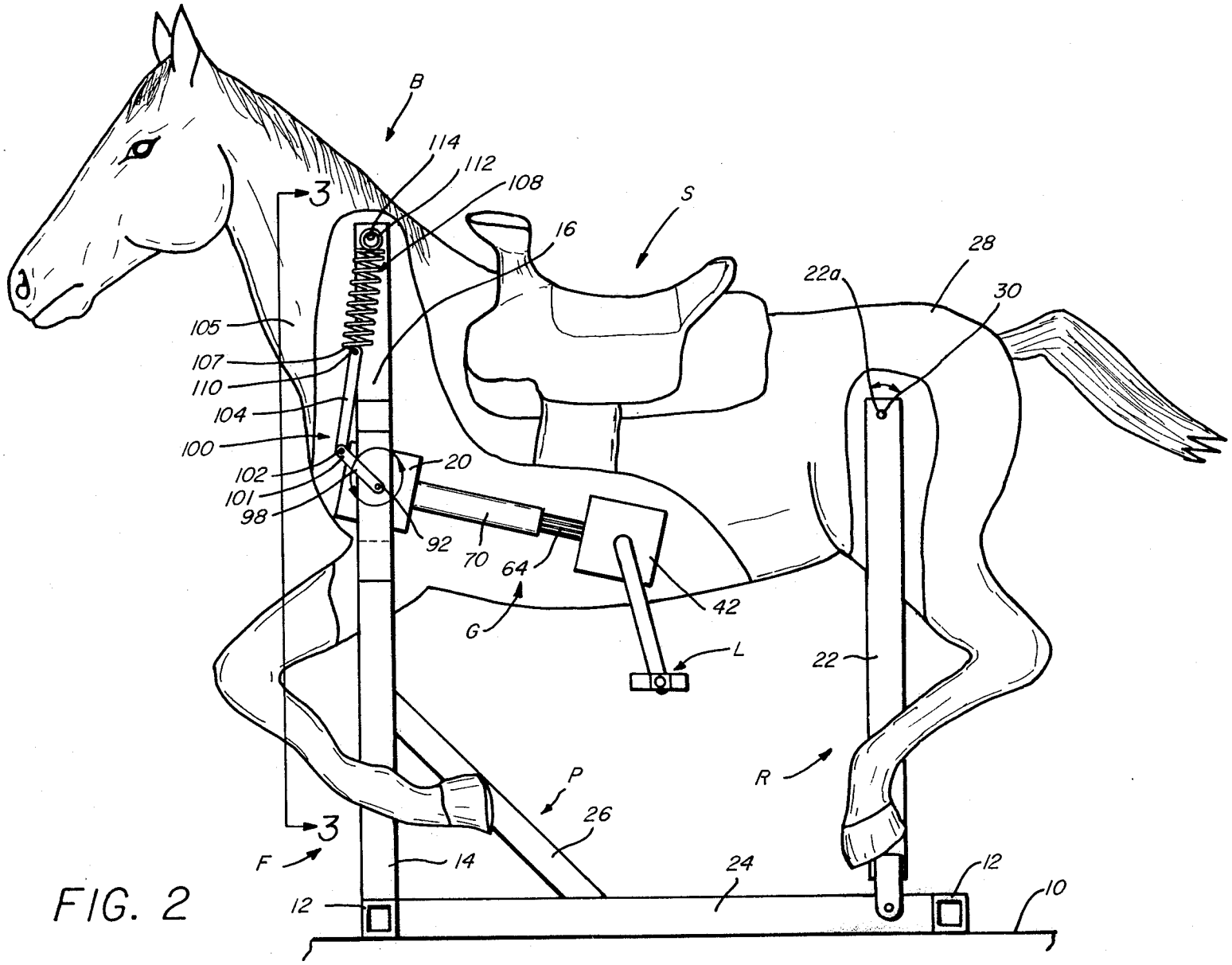
FIG. 2 is an elevation view, partly broken away, of the animated exerciser apparatus of FIG. 1.

As the pedals L are driven, the gear mechanism G imparts a rotary motion to the linkage arm system 100, causing the body B to move in an upward and forward, and reverse, elliptical pattern as indicated by the arrows in FIG. 2, simulating the running movement of an animal. Because of the longitudinal and rotational movement between the splined gear teeth 74 and the gear sleeve 70, this movement of the body B can occur continuously during the pedaling cycle, even with the forward and reverse movement of the body B with respect to the front support F. Also, as has been noted above, the gear mechanism G is entirely contained within the body B. Thus, particularly when children are using the apparatus A, the risk of injury or harm because of contact with the moving parts of the gear mechanism G is reduced to substantially nil.

The foregoing disclosure and description of the invention are illustrative and explanatory thereof, and various changes in the size, shape and materials, as well as in the details of the illustrated construction may be made without departing from the spirit of the invention.

I claim:

1. A stationary exerciser apparatus, comprising:

(a) body means for stimulating a movable body;
(b) said body means having a surface thereon where a rider may sit;
(c) support means for supporting said body means for movement above a floor or surface, said support means comprising:
(1) front support means mounted within a front portion of said body means; and
(2) rear support means mounted within a rear portion of said body means;
(d) pedal means engageable by the rider's feet for being driven thereby;
(e) said pedal means being mounted extending externally from said body means; and
(f) gear means mounted internally within said body means and responsive to said pedal means for causing rotary movement of said body means with respect to said front support means to simulate a movable body.

2. The apparatus of claim 1, wherein:
said body means comprises means for simulating the body of an animal.

3. The apparatus of claim 1, wherein said gear means comprises:
means causing rotary movement of said front portion of said body means with respect to said front support means.

4. The apparatus of claim 1, further including:
means for causing pivotal movement of said body means with respect to said rear support means.

5. The apparatus of claim 1, further including:
means for causing pivotal movement of said rear portion of said body means with respect to said rear support means.

6. The apparatus of claim 1, wherein:
said rider support surface is located on said body means between said front support means and said rear support means.

7. The apparatus of claim 1, wherein said gear means comprises:
(a) a rear gear driven by said pedal means;
(b) a front gear moving said body means relative to said support means; and
(c) drive shaft means driven by said rear gear for driving said front gear, said drive shaft means being longitudinally movable within said front gear while driving same.

8. The apparatus of claim 1, further including:
spring means mounted between said body means and said support means for bearing at least a portion of the weight of the rider and said body means.

9. A stationary exerciser apparatus, comprising:
(a) body means for simulating a movable body;
(b) said body means having a surface thereon where a rider may sit;
(c) support means for supporting said body means for movement above a floor or surface said support means comprising:
(1) a front support post mounted within a front portion of said body means;
(2) support arms extending outwardly from said front support post;
(3) a rear support post mounted within a rear portion of said body means;
(4) support arms extending outwardly from said rear support post;
(d) spring means mounted between said front portion of said body means and said front support post for bearing at least a portion of the weight of the rider and said body means;
(e) pedal means engageable by the rider's feet for being driven thereby;
(f) gear means responsive to said pedal means for moving said body means relative to said support means to simulate a movable body.

10. The apparatus of claim 9, wherein said gear means comprises:
means causing rotary movement of said body means with respect to said front support means.

11. The apparatus of claim 10, wherein said gear means comprises:
(a) a rear gear driven by said pedal means;
(b) a front gear moving said body means relative to said support means; and
(c) drive shaft means driven by said rear gear for driving said front gear said drive shaft being longitudinally movable within said front gear while driving same.

12. The apparatus of claim 11, wherein said gear means further includes:
a rotary drive linkage driven by said front gear.

13. The apparatus of claim 12, wherein:
said spring means is connected at a first end to said front portion of said body means and at a second end through said rotary drive linkage to said front support means.

14. A stationary exerciser apparatus, comprising:
(a) body means for simulating a movable body;
(b) said body means having a surface thereon where a rider may sit;
(c) support means for supporting said body means for movement above a floor or surface;
(d) pedal means engageable by the rider's feet for being driven thereby;
(e) gear means mounted internally within said body means and responsive to said pedal means for moving said body means relative to said support means to simulate a movable body, said gear means comprising:
(1) a rear gear driven by said pedal means;
(2) a front gear moving said body means relative to said support means; and
(3) drive shaft means driven by said rear gear for driving said front gear, said drive shaft means being longitudinally movable within said front gear while driving same.

15. The apparatus of claim 14, wherein:
said rear gear comprises a reduction gear.

16. The apparatus of claim 14, wherein:
said front gear comprises a reduction gear.

17. The apparatus of claim 14, further including:
spring means mounted between said body means and said support means for bearing at least a portion of the weight of the rider and said body means.

18. A stationary exerciser apparatus, comprising:
(a) body means for simulating a movable body;
(b) said body means having a surface thereon where a rider may sit;
(c) support means for supporting said body means for movement above a floor or surface;
(d) pedal means engageable by the rider's feet for being driven thereby;
(e) said pedal means being mounted extending externally from said body means; and
(f) gear means mounted internally within said body means and responsive to said pedal means for moving said body means relative to said support means to simulate a movable body, said gear means comprising:

(1) a rear gear driven by said pedal means;

(2) a front gear moving said body means relative to said support means; and (3) drive shaft means driven by said rear gear for driving said front gear, said drive shaft means being longitudinally movable within said front gear while driving same.

* * * * *